US010845039B2

(12) United States Patent
Chamberlain et al.

(10) Patent No.: US 10,845,039 B2
(45) Date of Patent: Nov. 24, 2020

(54) LIGHT POLE RETROFIT MOUNTING BRACKET

(71) Applicant: Linmore LED Labs, Inc., Fresno, CA (US)

(72) Inventors: Paul Chamberlain, Fresno, CA (US); John Gilmore, Fresno, CA (US); Cooper Wallace, Fresno, CA (US)

(73) Assignee: Linmore LED Labs, Inc., Fresno, CA (US)

( * ) Notice: Subject to any disclaimer, the term of this patent is extended or adjusted under 35 U.S.C. 154(b) by 0 days.

(21) Appl. No.: 16/659,234

(22) Filed: Oct. 21, 2019

(65) Prior Publication Data

US 2020/0240620 A1 Jul. 30, 2020

Related U.S. Application Data

(60) Provisional application No. 62/797,609, filed on Jan. 28, 2019.

(51) Int. Cl.
*F21V 21/116* (2006.01)
*F21V 15/01* (2006.01)

(52) U.S. Cl.
CPC ..... *F21V 21/116* (2013.01); *F21V 15/01* (2013.01)

(58) Field of Classification Search
CPC ..... F21V 21/16; F21V 15/01
See application file for complete search history.

(56) References Cited

U.S. PATENT DOCUMENTS 5,016,150 A * 5/1991 Gordin ..... F21S 8/033 362/263
5,667,188 A * 9/1997 Bettinsoli ..... F21S 8/086 248/558
5,941,485 A * 8/1999 Davidson ..... E04H 12/08 248/218.4
8,061,666 B1 * 11/2011 Fortin ..... F21V 21/108 248/219.1
9,316,365 B1 * 4/2016 Ko ..... F21V 21/116
2012/0147585 A1 * 6/2012 Girouard ..... B60Q 1/2657 362/84
2017/0030563 A1 * 2/2017 Hunt ..... F21K 9/20

OTHER PUBLICATIONS

LSI Industries Inc., "Tellus 16" LED Area Light;" Oct. 3, 2017. www.lsi-industries.com.

* cited by examiner

*Primary Examiner* — Anita M King

(74) *Attorney, Agent, or Firm* — Stetina Brunda Garred & Brucker

(57) ABSTRACT

There is provided a mounting bracket for attaching a light fixture to a light pole, with the light pole having an external surface, an internal surface defining an internal cavity, and a pair of apertures extending from the external surface to the internal surface. The mounting bracket includes an internal support sized and structured to be insertable within the internal cavity of the light pole. The internal support includes a housing and a pair of fasteners moveable relative to the housing and alignable with respective ones of the pair of apertures. An external support is sized and structured to be positionable adjacent the external surface of the light pole, the external support having a pair of slots formed therein and alignable with respective ones of the pair of fasteners. A mount body is slidably engageable with the external support and is pivotally connectable to the light fixture.

20 Claims, 6 Drawing Sheets

LIGHT POLE RETROFIT MOUNTING BRACKET

CROSS-REFERENCE TO RELATED APPLICATIONS

The present application claims the benefit of U.S. Provisional Application Ser. No. 62/797,609, filed Jan. 28, 2019, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to mounting hardware for attaching a light fixture to a light pole, and more specifically, to a mounting bracket which facilitates retrofitting the light fixture onto an existing light pole when replacing a previous light fixture.

2. Description of the Related Art

Light poles are commonly placed adjacent sidewalks, roads, and other thoroughfares to provide a raised source of light thereto. In addition to providing a raised location to which a light fixture may be attached, the light pole may also provide a pathway for electrical wiring to the light element within the light fixture. In the past, many light fixtures have included incandescent lighting elements or gas-discharge lamps as a light source.

Over time, a given light fixture may become outdated, either aesthetically or functionally. From an aesthetic standpoint, the original design of the light fixture may become outdated and may give rise to a desire to replace the outdated design with an updated, more up-to-date design. Furthermore, if the original fixture is located outside, constant exposure to the sun or precipitation may weather the light fixture, thereby resulting in the loss of aesthetic appeal.

Advancements in lighting technology may also prompt replacement of an older light fixture. For instance, conventional incandescent and gas-discharge lamps are being replaced with more energy efficient light-emitting diode (LED) lamps.

Although replacement of a previous light fixture with a new light fixture may be desirable, such replacement may also be associated with complications. For instance, the previous light fixture may be attached to the light pole via mechanical fastener extending through openings formed in the light pole. There is not a standard spacing between the openings which accommodate the mechanical fasteners, and thus, the new light fixture may require an opening spacing that differs from the original spacing.

Accordingly, there is a need in the art for mounting hardware which allows for replacement of an existing light fixture with a new light fixture. Various aspects of the present disclosure address this particular need, as will be discussed in more detail below.

BRIEF SUMMARY

In accordance with one embodiment of the present disclosure, a mounting bracket may be provided which may facilitate attachment of a light fixture to a light pole having mounting apertures formed in the pole. The mounting bracket may be configured to allow for use with mounting apertures that may not have standard or common spacing therebetween. In this regard, the mounting bracket may include fasteners that are selectively moveable within a housing to achieve alignment with the existing mounting apertures. As such, the adjustability of the fasteners may eliminate the need to drill new mounting apertures into the pole, which may result in an easier and less time-consuming retrofit.

According to one embodiment, there is provided a mounting bracket for attaching a light fixture to a light pole, with the light pole having an external surface, an internal surface defining an internal cavity, and a pair of apertures extending from the external surface to the internal surface. The mounting bracket includes an internal support sized and structured to be insertable within the internal cavity of the light pole. The internal support includes a housing and a pair of fasteners moveable relative to the housing and alignable with respective ones of the pair of apertures. An external support is sized and structured to be positionable adjacent the external surface of the light pole, the external support having a pair of slots formed therein and alignable with respective ones of the pair of fasteners. A mount body is slidably engageable with the external support and is pivotally connectable to the light fixture.

The mounting bracket may include an adapter having an arcuate surface engageable with the external surface of the light pole and positionable between the external support and the light pole.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
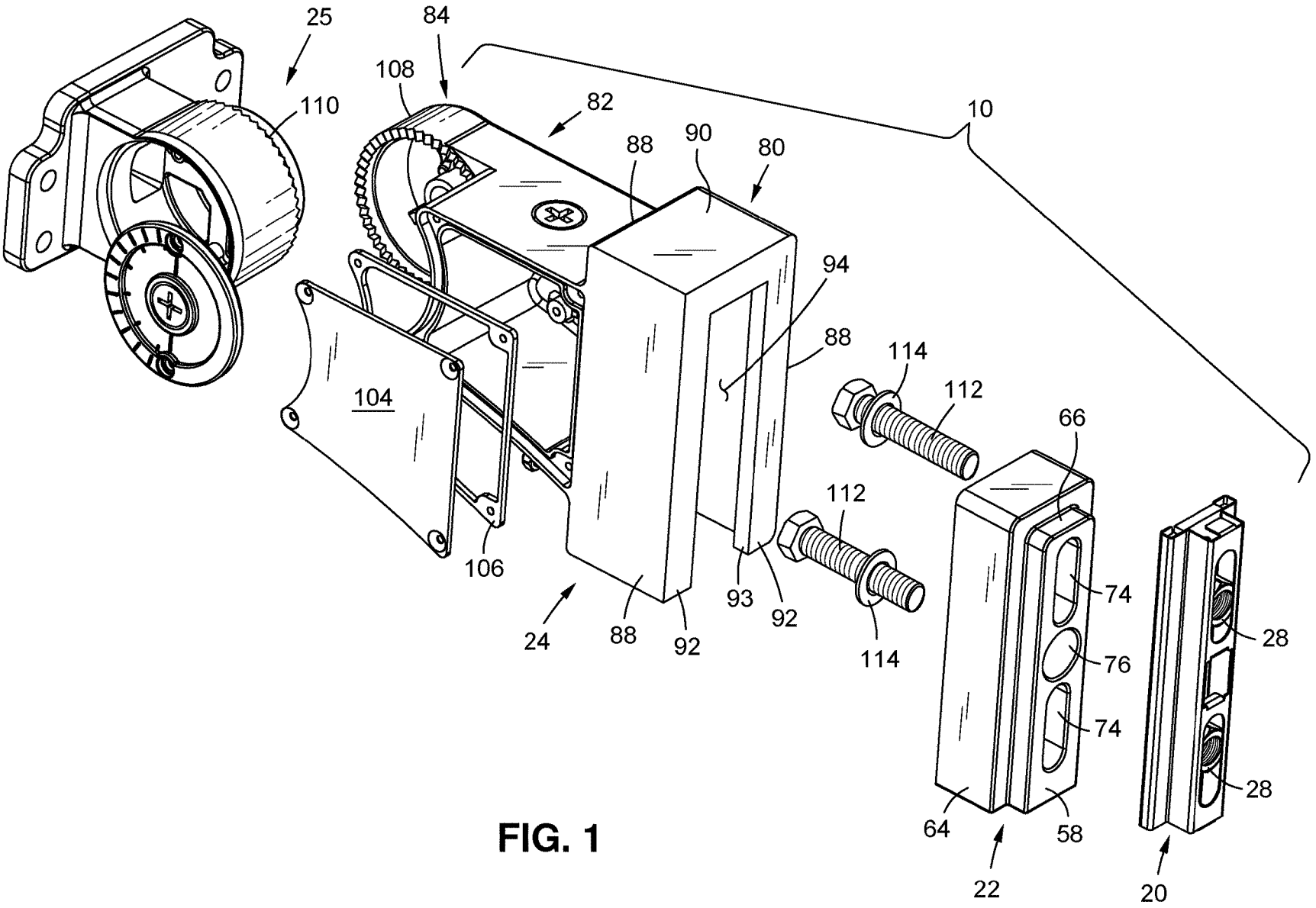
FIG. 1 is an exploded upper perspective view of a mounting bracket for attaching a light fixture to a light pole.
Figure 2:
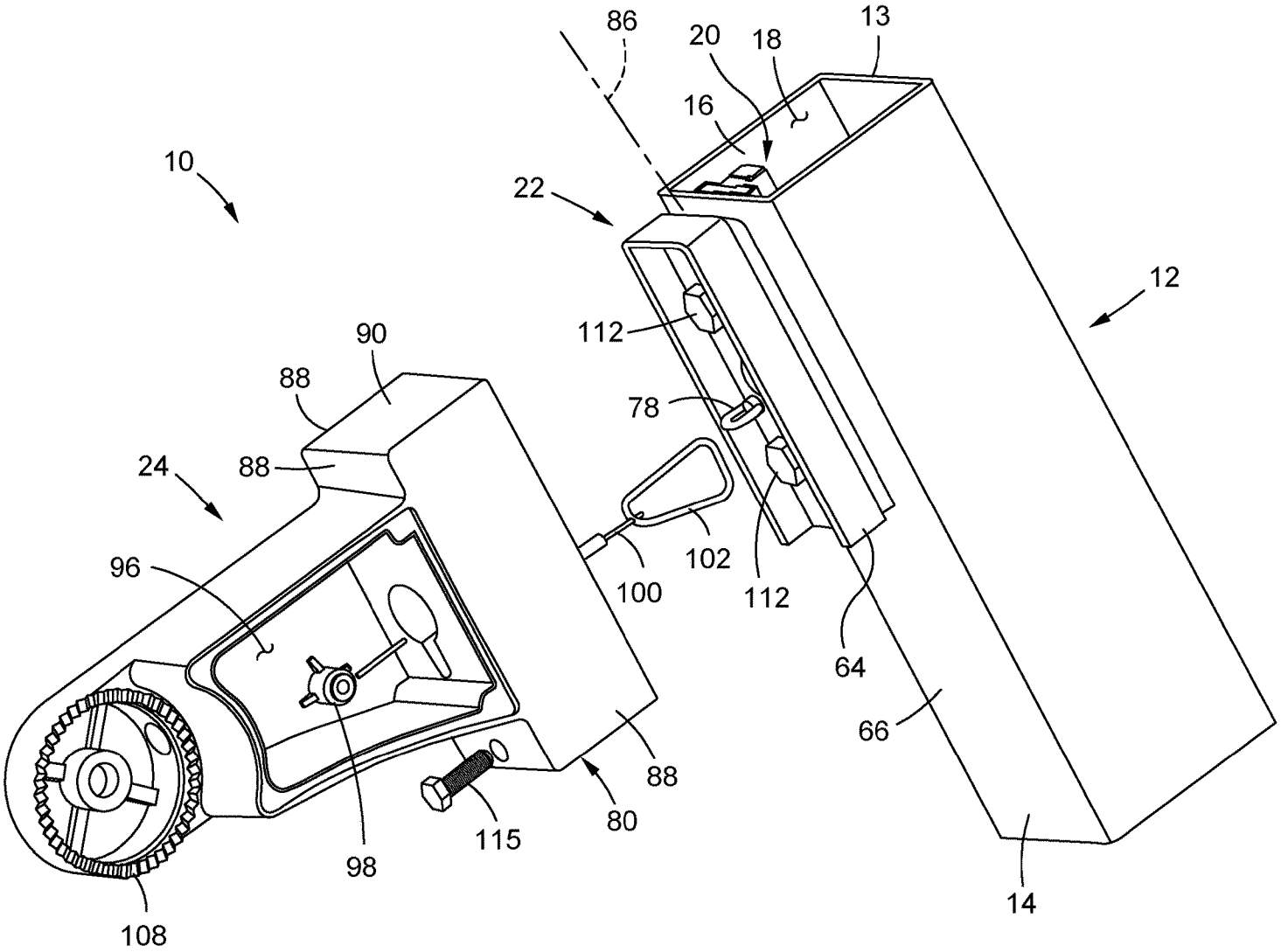
FIG. 2 is a partially exploded upper perspective view of the mounting-bracket being attached to a light pole having a generally quadrangular or square cross-sectional profile.

Referring now to FIGS. 1 and 2 of the drawings, wherein the showings are for purposes of illustrating a preferred embodiment of the present disclosure only, and are not for purposes of limited the same, there is depicted a mounting bracket 10 for mounting a light fixture to a light pole 12 (see FIG. 2), such as in a retrofit application. In this regard, the mounting bracket 10 may be specifically configured and adapted to allow the light fixture to be retrofitted onto an existing light pole 12, and to allow for selective angular positioning of the light fixture relative to the light pole 12.

The mounting bracket 10 may be configured for use with a light pole 12 that is tubular in construction and has a generally quadrangular or square cross-sectional profile. In this regard, the light pole 12 may include a wall 13 having an external surface 14 and an internal surface 16, with the internal surface 16 of the wall 13 defining an internal cavity 18 which extends into the light pole 12 in a longitudinal direction. The light pole 12 may include one or more preexisting apertures formed in a common one of the four sides or faces defined by the wall 13 which may have served as mounting apertures for a previous light fixture, as well as a passageway through which electrical wiring may extend.

According to one embodiment, the mounting bracket 10 generally includes an internal support 20, an external support 22 and a mount body 24, with the internal and external supports 20, 22 being connectable to each other such that the internal support 20 is positioned inside the internal cavity 18 of the light pole 12 and the external support 22 is positioned outside of internal cavity 18. The mount body 24 is configured to be selectively engageable with a connector 25 of the light fixture that is to be mounted on the light pole 12.

Figure 3:
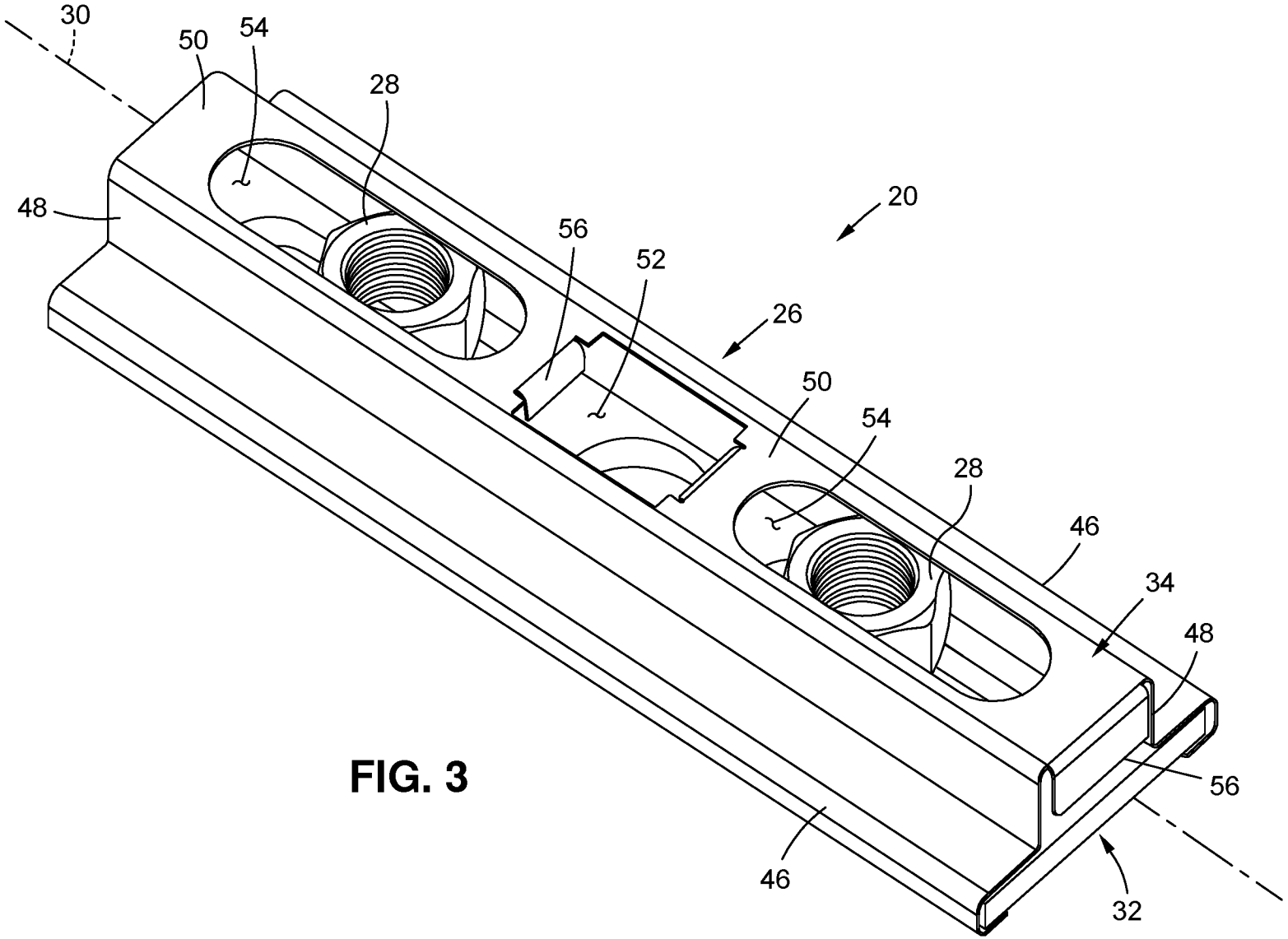
FIG. 3 is an upper perspective view of an internal support, which forms part of the mounting bracket.
Figure 4:
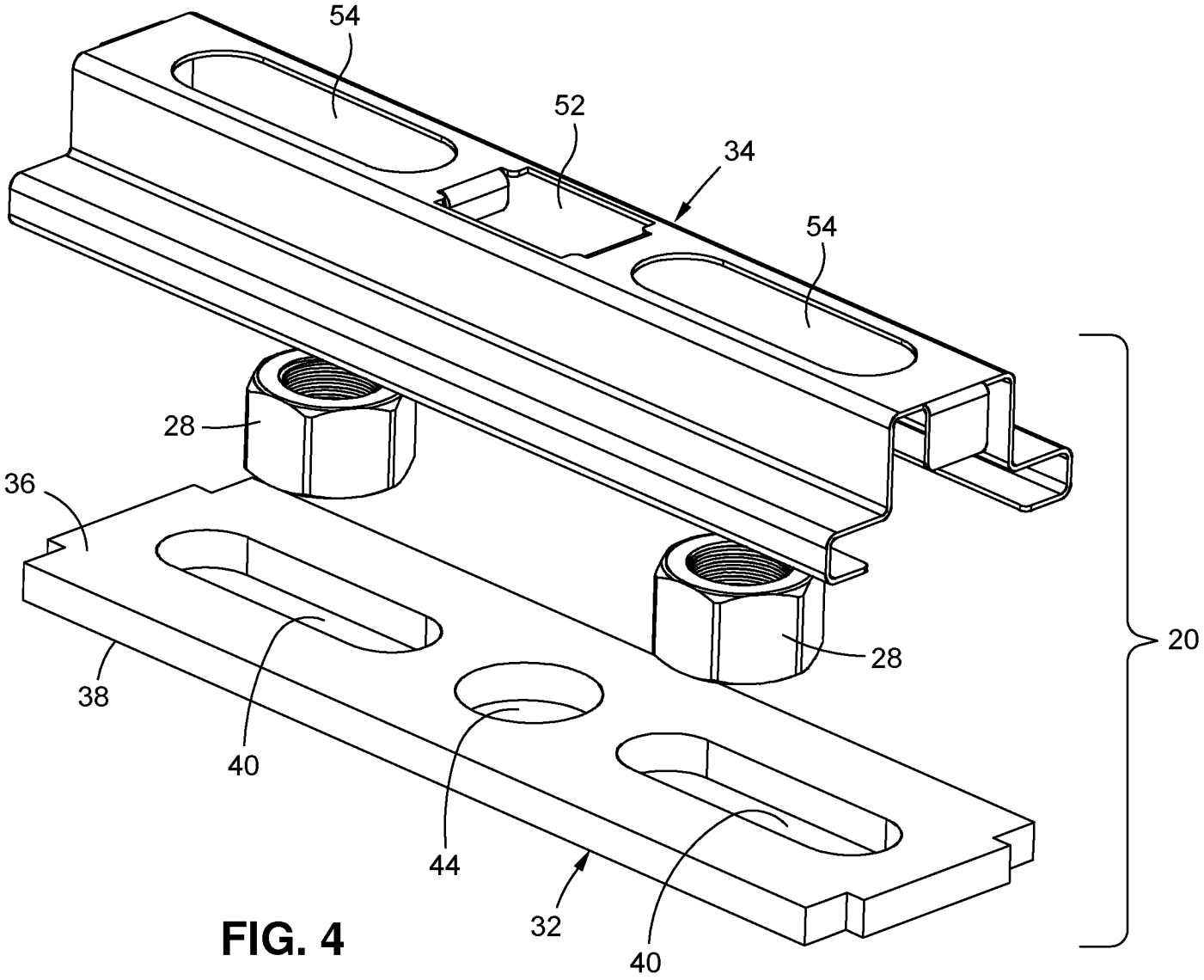
FIG. 4 is an exploded upper perspective view of the internal support.

Referring now specifically to FIGS. 3-4, the internal support 20 may include a housing 26, and a pair of fasteners 28 moveable within the housing 26. In more detail, the housing 26 may define a longitudinal axis 30, and may be comprised of a base plate 32 and a cover body 34 coupled to the base plate 32. The base plate 32 includes a pair of opposing planar surfaces 36, 38, along with a pair of elongate slots 40, and a central opening 44 positioned between the elongate slots 40. Each of the elongate slots 40 extends in one direction between the opposing planar surfaces 36, 38, and in another direction parallel to the longitudinal axis 30. In this respect, the elongate slots 40 may be coaxially aligned with each other. Each elongate slot 40 may define a length, i.e., the distance of the slot 40 along the longitudinal axis 30, that is greater than a width, i.e., the distance of the slot transverse to the longitudinal axis 30. For instance, each elongate slot 40 may be approximately 25%-35% of the overall length of the base plate 32.

The central opening 44 may be evenly spaced between the elongate slots 40. In the exemplary embodiment, the central opening 44 is shown as being circular, and may have a diameter that is approximately 10-15% of the overall length of the base plate 32. The central opening 44 may be used as a passageway for electrical wiring extending through the base plate 32. Although the exemplary embodiment shows the central opening 44 as having a circular configuration, it is contemplated that the central opening 44 may be quadrangular, triangular, oval, or other shapes known in the art.

The cover body 34 is sized and configured to fit around at least a portion of the base plate 32 and to retain the pair of fasteners 28 within respective cavities of the housing 26. Along these lines, the cover body 34 may include a pair of curved side portions 46 which extend around respective sides of the base plate 32. More specifically, each curved side portion 46 of the cover body 34 may form a channel which receives a respective side of the base plate 32. The cover body 34 additionally includes a central portion projecting between the pair of side portions 46. The central portion includes a pair of opposed sidewalls 48 extending from a respective side portion 46. The central portion additionally includes a pair of central walls 50 extending between the opposed sidewalls 48. The central walls 50 are separated from each other to define a central opening 52 therebetween. Each central wall 50 includes an elongate slot 54 formed therein, which is sized and configured to be similar to the elongate slots 40 formed in the base plate 32. In this regard, when the cover body 34 is coupled to the base plate 32, the elongate slots 54 in the cover body 34 are aligned with the elongate slots 40 in the base plate 32 in an overlapping configuration.

The cover body 34 may additionally include two pairs of tabs 56 which are used to retain the fasteners 28 in their respective cavities. In particular, each tab 56 extends from a respective end of the central wall 50 toward the base plate 32. As such, each central wall 50 includes a pair of tabs 56 extending from the opposed ends thereof. The base plate 32 and the cover body 34 collectively define a pair of cavities within which the fasteners 28 may be retained. Each cavity may be defined by the base plate 32, a central wall 50 and a pair of tabs 56.

The pair of fasteners 28 may be retained within the cavities and selectively moveable within their corresponding cavities for selective positional alignment with the elongate slots 40 formed in the base plate 32 and the elongate slots 54 formed in the cover body 34. The fasteners 28 may be translatable within the cavities along an axis parallel to the longitudinal axis 30 of the base plate 32. However, the configuration of the fasteners 28 and the cover body 34 may prevent rotation of the fasteners 28 relative to the cover body 34 or base plate 32. In the exemplary embodiment, each fastener 28 is a hex-nut having an internally threaded opening, wherein two opposing sides of the hex-nut are positioned adjacent the sidewalls 28 of the cover body 34. The distance between the opposing sides of the hex-nut are substantially similar, although slightly smaller, than the distance between the opposing sidewalls 28 of the cover body 34. In this regard, the sizing of the fasteners 28 and the cover body 34 prevent rotation of the fasteners 28 relative to the cover body 34 or base plate 32.

Figure 5B:
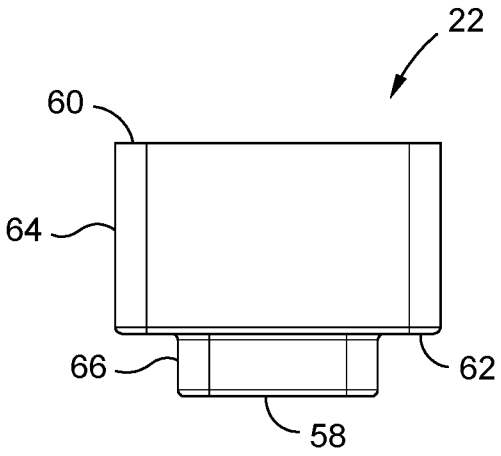
FIGS. 5A-B are perspective and end views of an external support, which forms part of the mounting bracket.
Figure 5A:
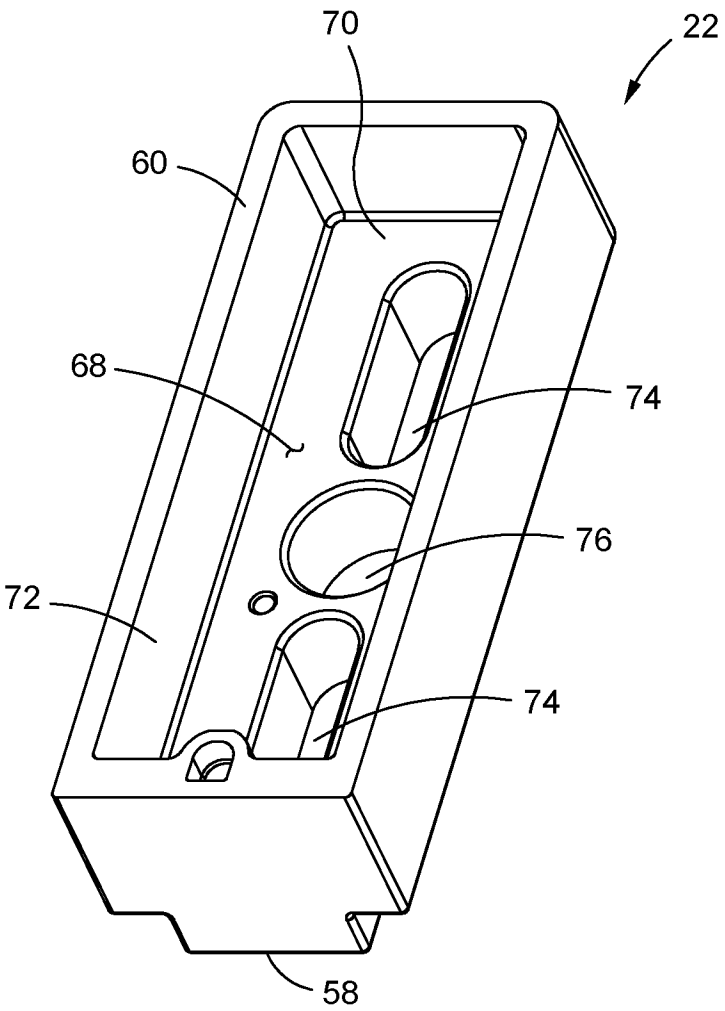

Referring now to FIGS. 5A and 5B, the external support 22 includes an abutment surface 58 and an external end surface 60. The external support 22 additionally includes an intermediate shoulder or surface 62 between the abutment surface 58 and external end surface 60, and generally parallel to the abutment surface 58 and the external end surface 60. A primary sidewall 64 may extend between the external end surface 60 and the intermediate surface 62, and a three-sided secondary sidewall 66 may extend between the intermediate surface 62 and the abutment surface 58. The secondary sidewall 66 may be inwardly offset from the primary sidewall 64 to create a space or three-sided recess which circumvents the secondary sidewall 66 and is collectively defined by both the secondary sidewall 66 and the intermediate surface 62. The use of such recess will be described in more detail below.

The external support 22 additionally includes an internal cavity 68, which extends into the external support 22 from the external end surface 60 and terminates at an internal end surface 70. An internal side surface 72 extends from the external end surface 60 to the internal end surface 70 such that the internal side surface 72 and internal end surface 70 collectively define the internal cavity 68.

The external support 22 further comprises a pair of elongate slots 74 and a central opening 76 similar to the elongate slots 40 and central opening 44 formed in the base plate 32 of the internal support 20. The pair of elongate slots 74 and central opening 76 extend from the abutment surface 58 to the internal end surface 70 and are in communication with the internal cavity 68. The external support 22 may additionally include an anchoring hook 78 (see FIG. 2) extending from the internal end surface 70, the purpose of which will be explained in more detail below.

Referring now back to FIGS. 1 and 2, the external support 22 interfaces with the mount body 24, which is generally comprised of an engagement sleeve 80, an electrical housing 82, and a distal end portion 84 engageable with the light fixture. The engagement sleeve 80 is complementary in shape to the external support 22 to allow the engagement sleeve 80 to slide over the external support 22 along an engagement axis 86 to effectuate engagement therebetween. The engagement sleeve 80 may include three sidewalls 88 arranged such that adjacent sidewalls 88 may form a right angle. The engagement sleeve 80 may additionally include an end wall 90 at one end thereof, and an opening at the opposite end. A three-sided, inwardly projecting flange 92 may extend from opposing sidewalls 88 and the end wall 90 and terminate at a distal inner edge 93 spaced from the sidewalls 88 and end wall 90. The inner edge 93 may define a cutout 94 which is complementary in shape to the secondary sidewall 66 of the external support 22. As will be explained in more detail below, the mount body 24 may be engaged to the external support 22 by sliding the engagement sleeve 80 over the external support 22 such that the primary sidewall 64 of the external support 22 is received into the interior of the engagement sleeve 80 concurrently with the secondary sidewall 66 being advanced into the cutout 94 in manner wherein the inner edge 93 of the inwardly projecting flange 92 may abut the secondary sidewall 66 of the external support 22. Stated another way, the sliding engagement of the engagement sleeve 80 to the external support 22 results in the three-sided flange 92 being effectively received into, and thus accommodated by, the three-sided recess collectively defined by both the secondary sidewall 66 and the intermediate surface 62, such recess having a configuration which is complementary to that of the flange 92.

The electrical housing 82 may extend from a sidewall 88 of the engagement sleeve 80 and provide a cavity 96 which may house electrical components, such as electrical wires and connections associated with the light fixture. An anchoring post 98 may extend from the electrical housing 82 into the cavity 96. A tether 100 may be coupled to the anchoring post 98 and may have a clip 102 coupled to an end portion thereof. The clip 102 may be engageable with the anchoring hook 78 on the external support 22 to provide a preliminary connection between the mount body 24 and the external support 22. A cover plate 104 may be engageable with the electrical housing 82 to cover the cavity 96 once the electrical work is complete. A gasket 106 may be positioned between the cover plate 104 and the electrical housing 82 to mitigate moisture migration from outside the electrical housing 82 into the cavity 96.

The distal end portion 84 of the mount body 24 may include a circular serrated surface 108, which allows for selective pivotal indexing of the light fixture relative to the mount body 24. In this regard, the connector 25 of the light fixture may include a complementary circular serrated surface 110 (see FIG. 1) that may cooperatively engage with the serrated surface 108 of the distal end portion 84.

With the basic structure of the mounting bracket 10 described above, the following discussion relates to an exemplary installation of the mounting bracket 10 on the light pole 12 to replace an old light fixture with a new light fixture. As indicated above, the exemplary light pole 12 has a tubular configuration with a generally square cross-sectional profile. The old light fixture is detached from the light pole 12, along with all electrical wiring associated with the old light fixture. The mounting bracket 10 may be adapted to allow for use of the pre-existing apertures formed in the light pole 12 to avoid the need to drill new holes specifically sized for the new light fixture. In this regard, the external support 22 is positioned adjacent the external surface 14 of one of the four sides or faces of the light pole 12 having the pre-existing apertures or holes therein, with the abutment surface 58 of the external support 22 contacting the generally planar external surface 14 of the light pole 12. In this position, the cavity of the external support 22 is exposed and facing away from the light pole 12. The central opening 76 of the external support 22 is aligned with the electrical opening in the light pole 12 and the elongate slots 74 of the external support 22 are aligned with the pre-existing mounting apertures formed in the light pole 12. In this regard, such alignment may require that the axes about which the light pole mounting apertures are formed extend through the elongate slots 74 of the external support 22. The elongate nature of the slots 74 allows for variance in the distance between the pre-existing mounting apertures. For instance, there may not be a standard distance between the mounting apertures associated with different light fixtures, and thus, the elongate slots 74 provide some variability in the distance between the mounting apertures, while still allowing for alignment with the elongate slots 74.

A pair of bolts 112 may be advanced through the aligned elongate slots 74 and mounting apertures of the light pole 12. Each bolt 112 may include a washer 114 disposed thereon, such that the washer 114 is positioned between the head of the bolt 112 and the internal end surface 70 of the external support 22.

The internal support 20 is then positioned within the cavity of the light pole 12 adjacent the bolts 112, whose ends may be partially extending into the cavity 18 of the light pole 12. The base plate 32 is positioned adjacent the internal surface 16 of the wall 13 of the light pole 12, with the central opening 44 of the base plate 32 aligned with the electrical opening in the light pole 12 and the elongate slots 40 of the base plate 32 are aligned with the protruding bolts 112. One of the fasteners 28 is then moved into alignment with the corresponding protruding bolt 112 to allow for threaded engagement between the bolt 112 and the fastener 28. The bolt 112 is then rotated to facilitate such threaded engagement with the fastener 28.

Before the bolt 112 is completely tightened on the fastener 28, the remaining fastener 28 is aligned with the remaining bolt 112. Such alignment may require translation of one or both of the fasteners 28 within the respective cavities. In this regard, the fasteners 28 may be moved to create spacing between the fasteners 28 that is equal to the spacing between the bolts 112. Once the remaining fastener 28 is aligned with the remaining bolt 112, the remaining bolt 112 may be rotated to facilitate threaded engagement with the remaining fastener 28. When both bolts 112 are engaged with the fasteners 28, the bolts 112 may be tightened.

As the bolts 112 are rotated and engaged with the fasteners 28, the heads of the bolts 112 are received within the internal cavity 68 of the external support 22. In this regard, the external support 22 may be sized to allow a tool such as a wrench or socket head to interface with the bolt head when the bolt head is received within the internal cavity 68.

With the internal and external supports 20, 22 connected to the light pole 12, the mount body 24 may be connected to the external support 22. To facilitate an initial, temporary connection between the mount body 24 and the external support 22, the anchoring clip 102 may be connected to the anchoring hook 78, which allows the mount body 24 to hang from the anchoring hook 78 to allow the hands of the installer to perform other work, such as performing electrical work.

The facilitate the permanent, rigid connection between the mount body 24 and the external support 22, the mount body 24 may be placed over the external support 22, such that the open cavity of the mount body 24 is aligned with the portion of the external support 22 associated with the primary sidewall 64, and the inwardly projecting flange 92 is aligned with the secondary sidewall 66 of the external support 22. The mount body 24 is then moved in a downward direction along the engagement axis 86 toward the external support 22, such that the opposed side portions of the inwardly projecting flange 92 interface with the opposing side portions of the secondary sidewall 66. The mount body 24 continues in the downward motion until the transverse portion of the inwardly projecting flange 92 interfaces with a corresponding transverse portion of the secondary sidewall 66. Gravity may cause the transverse portion of the inwardly projecting flange 92 to rest on the transverse portion of the secondary sidewall 66, and thus, secure the mount body 24 to the external support 22. As will be recognized, with the external support 22 being mounted to the wall 13 of the light pole 12 in the aforementioned manner (i.e., the abutment surface 58 being in direct contact with the external surface 14), the recess which is collectively defined by both the secondary sidewall 66 and the intermediate surface 62 and slidably accommodates the flange 92 is partially enclosed, and thus further partially defined by, the external surface 14 of the wall 13 upon the attachment of the of the external support 22 thereto. Though gravity based on the weight of the mount body 24 (especially upon the attachment of a light fixture thereto) will typically maintain the mount body 24 in firm engagement to the external support 22, it is contemplated that a fastener 115 such as a lock screw (as shown in FIG. 2) may be advanced through a complementary opening in the engagement sleeve 80 and into a complementary internally threaded opening in the external support 22 to maintain the mount body 24 in rigid attachment to the external support 22.

With the mounting bracket 10 secured to the light pole 12, the light fixture may be secured to the mounting bracket 10. The circular serrated edge 110 of the light fixture may be moved into engagement with the circular serrated edge 108 of the mounting bracket 10. A screw or bolt may extend through the distal end portion of the mounting bracket 10 to secure it to the light fixture. Before the screw or bolt is tightened, the light fixture may be indexed or pivoted relative to the mounting bracket 10 to assume a desired angular orientation relative to the light pole 12. In this regard, the light emitted from the light fixture may be angled in a desired area by adjusting the angular orientation of the light fixture relative to the light pole 12.

The foregoing describes the structure and use of a mounting bracket 10, wherein the external support 22 may interface directly with the light pole 12. In this regard, the end surface of the external support 22 may be planar, which may be preferable when connecting the external support 22 to a corresponding planar side or face of the wall 13 of the quadrangular light pole 12 or any other light pole defining a generally flat surface to which the external support 22 may be attached.

Figure 6:
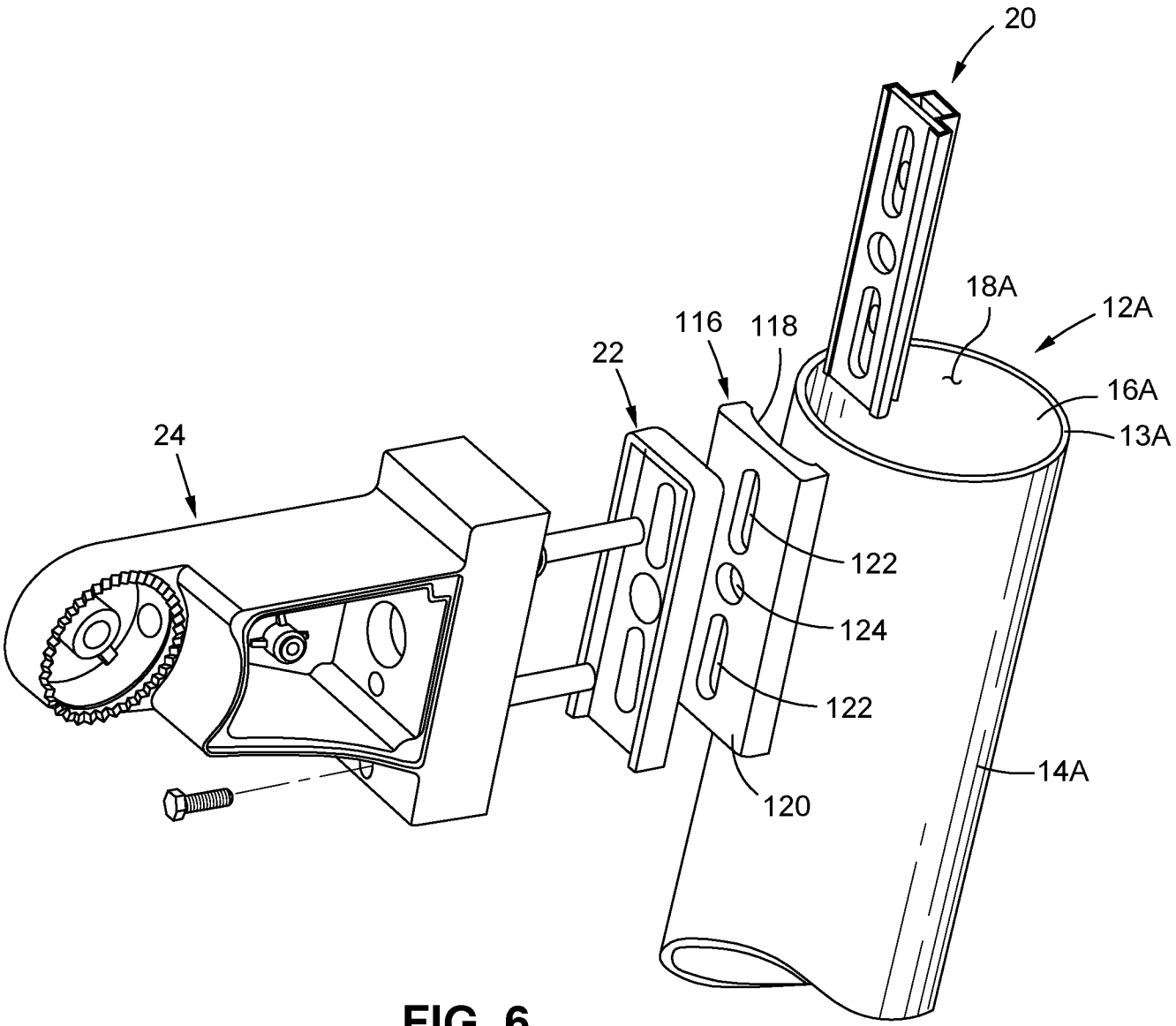
FIG. 6 is an exploded upper perspective view of an embodiment of the mounting bracket including an adapter for interfacing with a light pole having a generally circular cross-sectional profile.

However, it is understood that the mounting bracket 10 may also be adapted to facilitate its retrofit engagement to a tubular light pole having a generally circular cross-sectional configuration, such as the light pole 12A shown in FIG. 6. This exemplary round light pole 12A includes a wall 13A having an external surface 14A and an internal surface 16A, with the internal surface 16A of the wall 11A defining an internal cavity 18A which extends into the light pole 12 in a longitudinal direction. Thus, one embodiment of the mounting bracket 10 for used in conjunction with the light pole 12A includes an adapter 116 which resides between the external support 22 and the curved or arcuate external surface 14A of the round light pole 12A. The adaptor 116 may include an arcuate surface 118 that may be complementary to the external surface 14A of the light pole 12A. Opposite the arcuate surface 118 may be a generally planar surface 120, which is sized and configured to interface with the abutment surface 58 of the external support 22. The adapter 116 may additionally include a pair of elongate slots 122 and a central opening 124, which may be aligned with the elongate slots 74 and central opening 76 on the external support 22.

When installing the mounting bracket 10 on the round light pole 12A, a similar method to that described above is used, however, instead of placing the external support 22 directly against a generally planar exterior surface such as that defined by the light pole 12, the arcuate surface 118 of the adapter 116 is placed against the external surface 14A of the light pole 12A, with the abutment surface 58 of the external support 22 being placed against the surface 120 of the adapter 116. When the external support 22 is positioned against the adapter 116 in the prescribed manner, the central opening 124 of the adapter 116 is generally coaxially aligned with the central opening 76 of the external support 22, with the slots 122 of the adaptor 116 being generally aligned with respective ones of the slots 74 of the external support 22. Thus, as will be recognized, with the adaptor 116 being effectively positioned between the external surface 14A of the light pole 12A and the external support 22, the retrofit operation involves the advancement of the bolts 112 through the aligned slots 74, 122 as opposed to the slots 74 alone, and the advancement of electrical wires through the aligned openings 124, 76 as opposed to the opening 76 alone. With the external support 22 being mounted to the adaptor 116 in the aforementioned manner (i.e., the abutment surface 58 being in direct contact with the surface 120), the recess which is collectively defined by both the secondary sidewall 66 and the intermediate surface 62 and slidably accommodates the flange 92 is partially enclosed, and thus further partially defined by, the surface 120 of the adaptor 116 upon the attachment of the of the external support 22 thereto.

The particulars shown herein are by way of example only for purposes of illustrative discussion and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. A mounting bracket for attaching a light fixture to a light pole having an external surface, an internal surface defining an internal cavity, and a pair of apertures extending from the external surface to the internal surface, the mounting bracket comprising:

an internal support sized and structured to be insertable within the internal cavity of the light pole, the internal support having a housing and a pair of fasteners moveable relative to the housing and alignable with respective ones of the pair of apertures;

an external support sized and structured to be positionable adjacent the external surface of the light pole, the external support having a pair of slots formed therein and alignable with respective ones of the pair of fasteners; and a mount body slidably engageable with the external support and pivotally connectable to the light fixture.

2. The mounting bracket recited in claim 1, wherein the housing of the internal support and the pair of fasteners are collectively configured to allow for translation of the fasteners relative to the housing, and restrict rotation of the fasteners relative to the housing.

3. The mounting bracket recited in claim 1, wherein the housing of the internal support defines a first region within which a first one of the pair of fasteners is moveable and a second region within which a second one of the pair of fasteners is moveable, the first region being spaced from the second region.

4. The mounting bracket recited in claim 3, wherein the housing of the internal support includes a central opening disposed about an axis extending between the first region and the second region.

5. The mounting bracket recited in claim 4, wherein the external support includes a central opening alignable with the central opening on the housing of the internal support.

6. The mounting bracket recited in claim 1, wherein the housing of the internal support includes a pair of slots, the pair of fasteners being selectively positionable along respective ones of the pair of slots.

7. The mounting bracket recited in claim 6, wherein the external support includes a pair of slots aligned with the pair of slots formed in the housing.

8. The mounting bracket recited in claim 1, wherein the housing of the internal support includes a base plate including a pair of base plate slots.

9. The mounting bracket recited in claim 8, wherein the housing of the internal support includes a cover body engageable with the base plate and including a pair of cover body slots aligned with the pair of base plate slots.

10. The mounting bracket recited in claim 1, wherein the external support includes a primary sidewall, a secondary sidewall spaced from the primary sidewall, and an intermediate surface extending between the primary sidewall and the secondary sidewall.

11. The mounting bracket recited in claim 10, wherein the mount body includes an engagement sleeve having an interior, the engagement sleeve being slidable over the external support such that at least a portion of the primary sidewall is received within the interior.

12. The mounting bracket recited in claim 11, wherein the engagement sleeve includes a sidewall and a flange extending inwardly from the sidewall, the flange extending over the intermediate surface of the external support when the external support is received within the interior of the engagement sleeve.

13. The mounting bracket recited in claim 11, wherein the mount body includes an end portion engageable with the light fixture and configured to facilitate selective pivotal indexing of the light fixture relative to the mount body.

14. The mounting bracket recited in claim 13, wherein the end portion of the mount body includes a circular serrated surface.

15. The mounting bracket recited in 1, further comprising an adapter having an arcuate surface engageable with the external surface of the light pole and positionable between the external support and the light pole.

16. A mounting bracket for attaching a light fixture to a light pole having at least one aperture formed therein, the mounting bracket comprising:

a first support sized and structured to be positionable adjacent the light pole, the first support having a housing and at least one fastener moveable relative to the housing for alignment with the at least one aperture on the light pole;

a second support sized and structured to be positionable adjacent the light pole such that the light pole extends between the first and second supports, the second support having at least one slot formed therein and alignable with the at least one fastener of the first support; and a mount body slidably engageable with at least one of the first and second supports and pivotally connectable to the light fixture.

17. The mounting bracket recited in claim 16, wherein the housing of the first support and the at least one fastener are collectively configured to allow for translation of the at least one fastener relative to the housing, and restrict rotation of the at least one fastener relative to the housing.

18. The mounting bracket recited in claim 16, wherein the housing of the first support includes at least one slot, the at least one fastener being selectively positionable along the at least one slot.

19. The mounting bracket recited in claim 16, wherein the second support includes a primary sidewall, a secondary sidewall spaced from the primary sidewall, and an intermediate surface extending between the primary sidewall and the secondary sidewall.

20. The mounting bracket recited in claim 19, wherein the mount body includes an engagement sleeve having an interior, the engagement sleeve being slidable over the second support such that at least a portion of the primary sidewall is received within the interior.

* * * * *